US005525099A

United States Patent [19]

Baird et al.

[11] Patent Number: 5,525,099

[45] Date of Patent: Jun. 11, 1996

[54] APPARATUS FOR LINEARLY DISPLACING A ROTATABLE SPINDLE

[75] Inventors: Charles J. Baird; Louis C. Brickner; Raymond L. Wilson, all of Pittsburgh, Pa.

[73] Assignee: Delta International Machinery Corp., Pittsburgh, Pa.

[21] Appl. No.: 291,528

[22] Filed: Aug. 19, 1994

[51] Int. Cl.[6] ..... B24B 19/00

[52] U.S. Cl. ..... 451/415; 451/157; 451/174

[58] Field of Search ..... 451/1, 5, 415, 451/162, 163, 174, 121, 150, 155; 408/17, 20, 27, 129

[56] References Cited

U.S. PATENT DOCUMENTS

| | | | |
|---|---|---|---|
| 2,519,542 | 8/1950 | Carey et al. . | |
| 2,930,164 | 3/1960 | Metoff | 451/415 |
| 2,933,864 | 4/1960 | Marshall | 451/415 |
| 3,247,622 | 4/1966 | Hackman, Jr. . | |
| 3,959,929 | 6/1976 | Fleischmann et al. | 451/174 |
| 4,553,920 | 11/1985 | Biadigo et al. . | |
| 4,555,229 | 11/1985 | Biadigo et al. . | |
| 4,557,640 | 12/1985 | Rottler . | |
| 5,402,605 | 4/1995 | Paules | 451/415 |

OTHER PUBLICATIONS

"Oscillating Spindle Sanders", Fine Woodworking, Sep./Oct. 1994, pp. 52–56.

"Buyer's Guide to Oscillating Spindle Sanders", American Woodworker, Oct. 1994, pp. 40–43.

*Primary Examiner*—Bruce M. Kisliuk
*Assistant Examiner*—Derris Banks
*Attorney, Agent, or Firm*—Kirkpatrick & Lockhart

[57] ABSTRACT

An apparatus is disclosed for linearly displacing a rotatable spindle relative to an object. The apparatus includes a support that is connectable to the spindle such that translation of the spindle relative to the support in a first direction is restrained, a rotatable shaft which is connected to the support such that translation of the shaft relative to the support in the first direction is restrained, and a rotational drive system rotatably connected to the shaft and rotatably connectable to the spindle, to transmit rotational drive from the spindle to the shaft. The apparatus also includes a contact piece eccentrically mounted to the shaft, wherein the contact piece has a contact surface thereon for contact with the object. Rotation of the shaft varies a distance, measured in the first direction, between the support and a portion of the contact surface contacting the object, such that the spindle is linearly displaceable relative to the object.

24 Claims, 6 Drawing Sheets

APPARATUS FOR LINEARLY DISPLACING A ROTATABLE SPINDLE

BACKGROUND OF THE INVENTION

1. Field of the Invention

The present invention relates to apparatuses useful for effectuating linear displacement. More particularly, the present invention relates to apparatuses for linearly displacing rotatable spindles.

2. Description of the Invention's Background

Currently, various abrading tool apparatuses that include an abrading tool such as a sanding drum, rasping drum, or wire paint stripper are available, wherein the tool both rotates and linearly oscillates. For example, a number of companies make oscillating spindle sanders, i.e., the Clayton 106 and 140, the Crouch 290-4.5, the Enlon EN3407, the Powermatic Artisan 14, the Ryobi OSS450, and the Vega 053, wherein a spindle having a sanding drum mounted thereto extends upwardly from a base and rotates and oscillates in a vertical direction relative to the base. Such oscillating spindle sanders are particularly useful for sanding curved surfaces, since they utilize a rotating sanding drum. Such sanders also have the advantage of using a majority of the drum surface during a sanding operation, due to the oscillating motion of the spindle, which extends the life of sandpaper placed around the sanding drum.

Abrading tool apparatuses which are stand-alone devices, such as the oscillating spindle sanders described above, have the disadvantage, however, of being both relatively expensive and of taking up a relatively large amount of extra space. For example, in a workshop which already includes a tool apparatus such as a drill press which includes a spindle which is rotatable, capable of linear oscillation, and able to hold an abrading tool, a stand-alone abrading tool is generally more expensive and takes up more space than an assembly which can be mounted to the tool apparatus to linearly oscillate the spindle.

For example, as stated in the October 1994 issue of American Woodworker, page 41, G. P. Designs, Inc. sells a kit which adds oscillating action to a drill press that is fitted with a sanding drum. The kit includes a motor that drives a push rod, which push rod is connected to one of the drill press spokes to force the spoke to rotate back and forth, and thus to force the spindle of the drill press to oscillate vertically. Such a kit disadvantageously requires a separate motor to impart an oscillating motion to the spindle, however, and it can thus be relatively more expensive to manufacture and to operate. Such a kit also requires a separate power cord for the separate motor, and it thus tends to clutter a workshop unnecessarily.

In view of the above, it is an object of the present invention to provide an improved apparatus for linearly displacing a rotatable spindle.

It is another object of the present invention to provide an apparatus for linearly displacing a rotatable spindle which apparatus is relatively inexpensive to manufacture and to operate.

It is a further object of the present invention to provide an apparatus for linearly displacing a rotatable spindle which takes up relatively little extra space in a workshop and adds relatively little extra clutter to a workshop.

Yet another object of the present invention is to provide an apparatus for linearly displacing a rotatable spindle which does not require a power source separate from a power source powering the spindle.

SUMMARY OF THE INVENTION

The above objects as well as other objects not specifically enumerated are accomplished by an apparatus for linearly displacing a rotatable spindle relative to an object, in accordance with the present invention. The apparatus of the present invention includes a support that is connectable to the spindle such that movement of the spindle relative to the support in a first direction is restrained, a rotatable shaft which is connected to the support such that movement of the shaft relative to the support in the first direction is restrained, and a rotational drive system rotatably connected to the shaft and rotatably connectable to the spindle, to transmit rotational drive from the spindle to the shaft. The apparatus also includes a contact piece eccentrically mounted to the shaft, wherein the contact piece has a contact surface thereon for contact with the object. Rotation of the shaft varies a distance, measured in the first direction, between the support and a portion of the contact surface contacting the object, such that the spindle is linearly displaceable relative to the object.

The objects of the invention are also accomplished by an apparatus for linearly displacing a rotatable spindle relative to an object, which apparatus includes rotatable shaft means, and support means for supporting the shaft means and restraining movement of the shaft means relative to the support means in a first direction. The support means includes means for restraining movement of the spindle relative to the support means in the first direction, and the apparatus includes rotational drive means, rotatably connected to the shaft means and rotatably connectable to the spindle, for transmitting rotational drive from the spindle to the shaft. The apparatus further includes contact means eccentrically mounted to the shaft means, wherein the contact means includes a contact surface for contacting the object. Rotation of the shaft means varies a distance, measured in the first direction, between the support means and a portion of the contact surface contacting the object, such that the spindle is linearly displaceable relative to the object.

The objects of the invention are also accomplished by an abrasive tool apparatus which includes (a) a drill press having a housing and a spindle, wherein the spindle is rotatable relative to the housing and is linearly displaceable relative to the housing in a first direction, (b) a linear displacement assembly, and (c) an abrasive tool fixed to the spindle. The linear displacement assembly includes a rotatable shaft, wherein the shaft is connected to the spindle such that movement of the shaft relative to the spindle in the first direction is restrained, and a rotational drive system rotatably connected between the spindle and the shaft to transmit rotational drive from the spindle to the shaft. The linear displacement assembly also includes a contact piece eccentrically mounted to the shaft and in contact with the housing, wherein rotation of the shaft varies a distance, measured in the first direction, between the housing and the shaft, such that rotation of the spindle linearly displaces the spindle relative to the housing.

BRIEF DESCRIPTION OF THE DRAWINGS

The preferred embodiment of the present invention will be described in greater detail with reference to the accompanying drawings, wherein like members bear like reference numerals and wherein.

DETAILED DESCRIPTION OF THE PREFERRED EMBODIMENT

Figure 1:
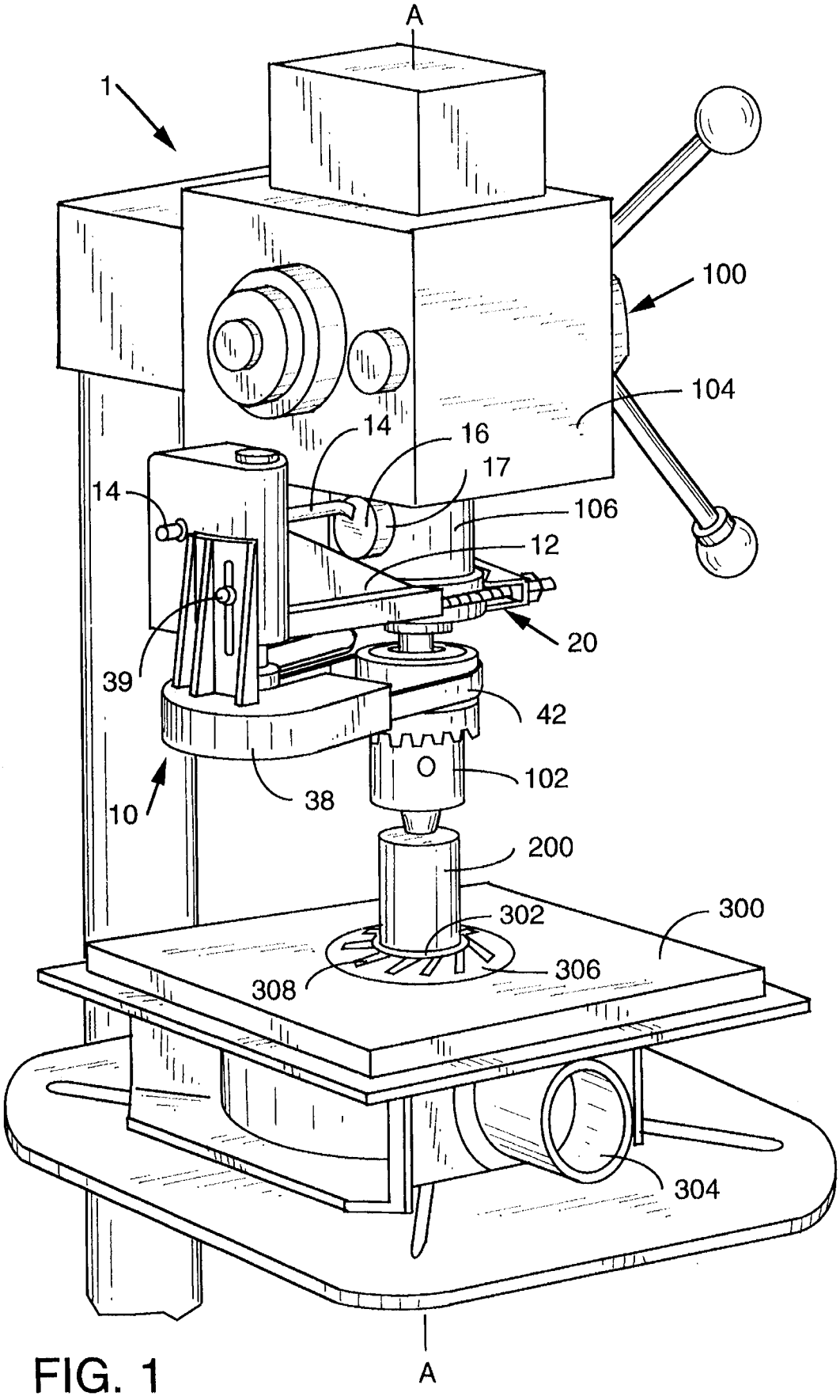
FIG. 1 is a perspective view of an apparatus of the present invention for linearly displacing a rotatable spindle, mounted to a rotatable spindle of a drill press and positioned in a first position.
Figure 2:
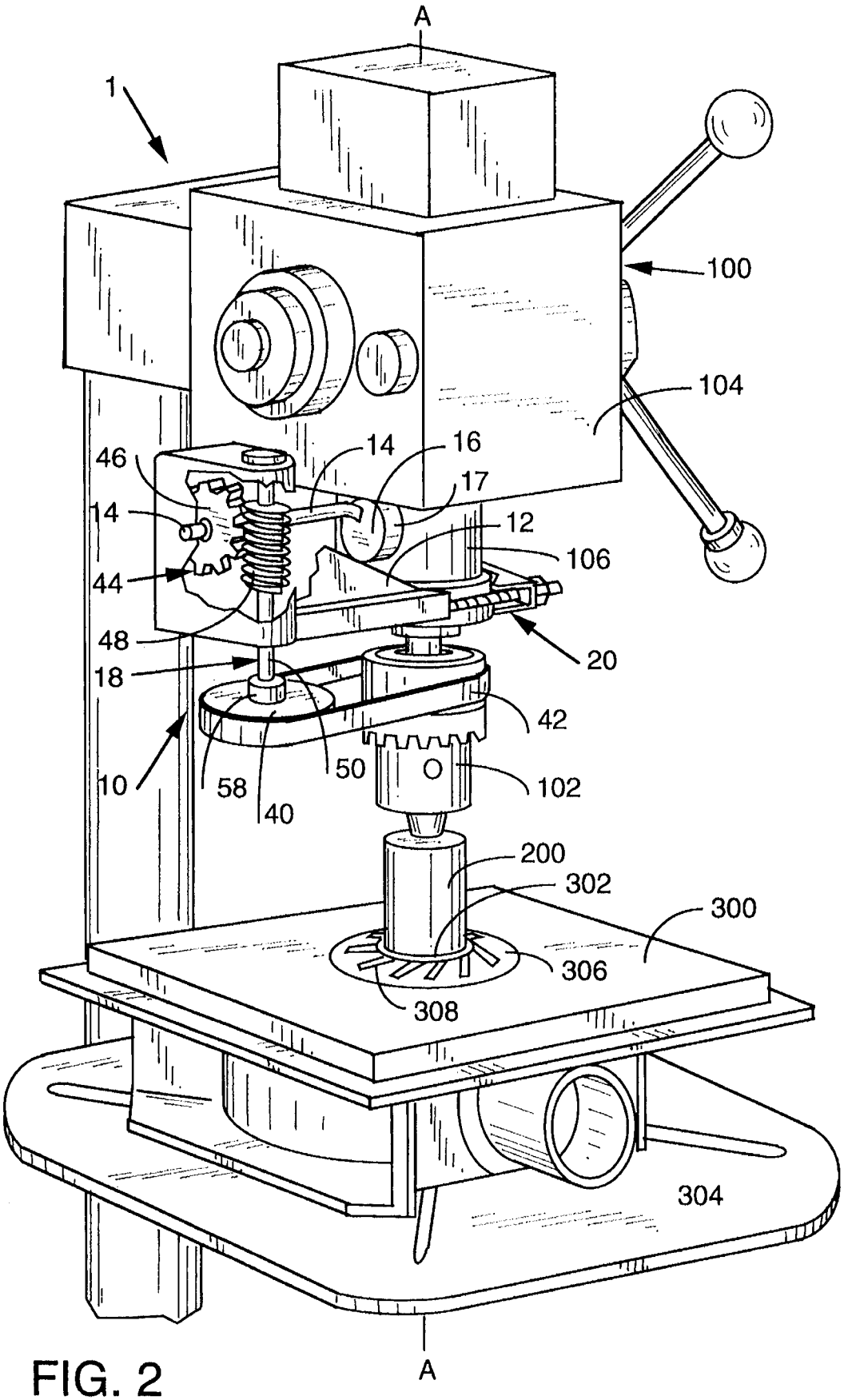
FIG. 2 is the perspective view of FIG. 1, with a housing of the apparatus of FIG. 1 removed and a support of the apparatus of FIG. 1 broken away, for clarity.
Figure 3:
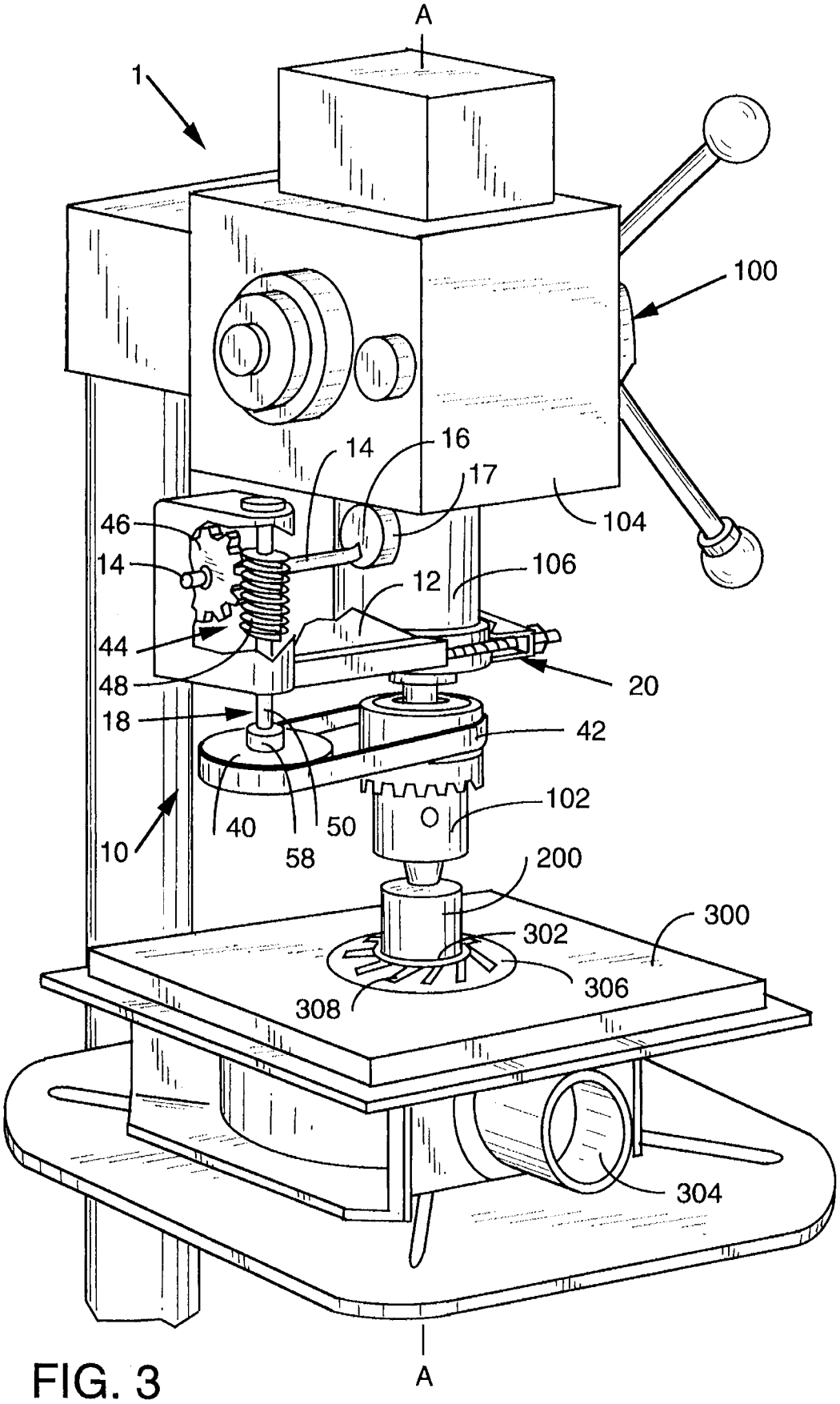
FIG. 3 is a perspective view similar to FIG. 2, with the apparatus positioned in a second position.
Figure 4:
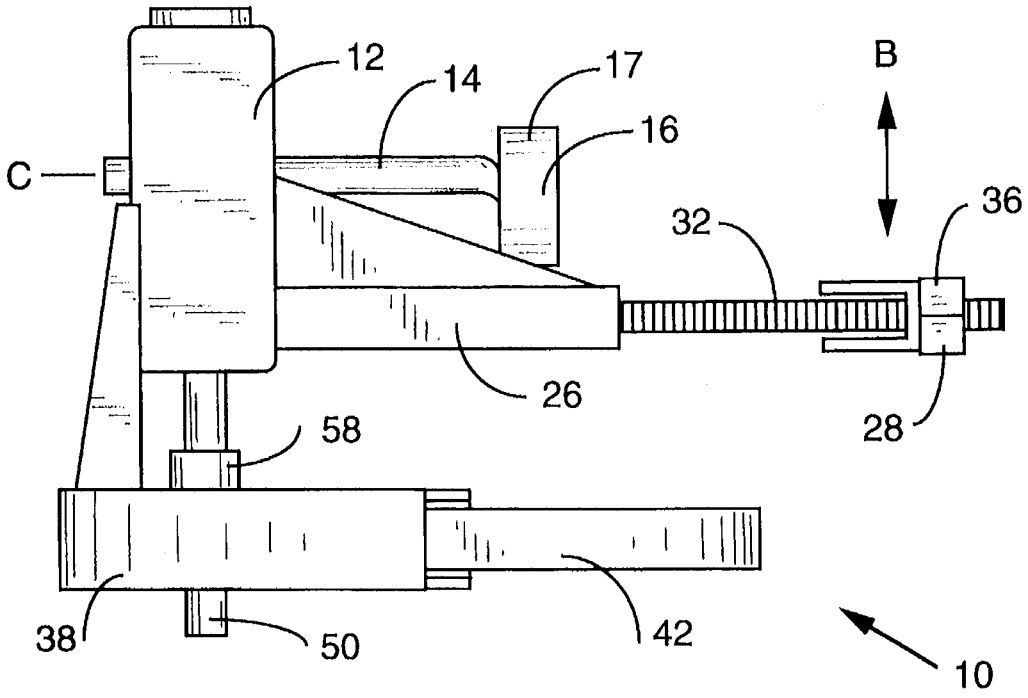
FIG. 4 is a front elevational view of the apparatus of FIG. 1.

With reference to FIGS. 1–9, and as shown more particularly in FIGS. 1–3, an apparatus 10 for linearly displacing a spindle in accordance with an embodiment of the present invention includes a support 12, a rotatable shaft 14 supported by the support 12, a contact piece 16 eccentrically mounted to the shaft 14, and a rotational drive system 18. The support 12 includes a clamp 20, which as seen most clearly in FIGS. 8 and 9, includes a first clamping surface 22 on a main body 26 of the support 12, a second clamping surface 24 on a clamping body 28 of the support 12, first and second threaded rods 30, 32 extending from the main body 26 through the clamping body 28, and first and second nuts 34, 36 threadedly engagable with the threaded rods 30, 32.

Figure 8:
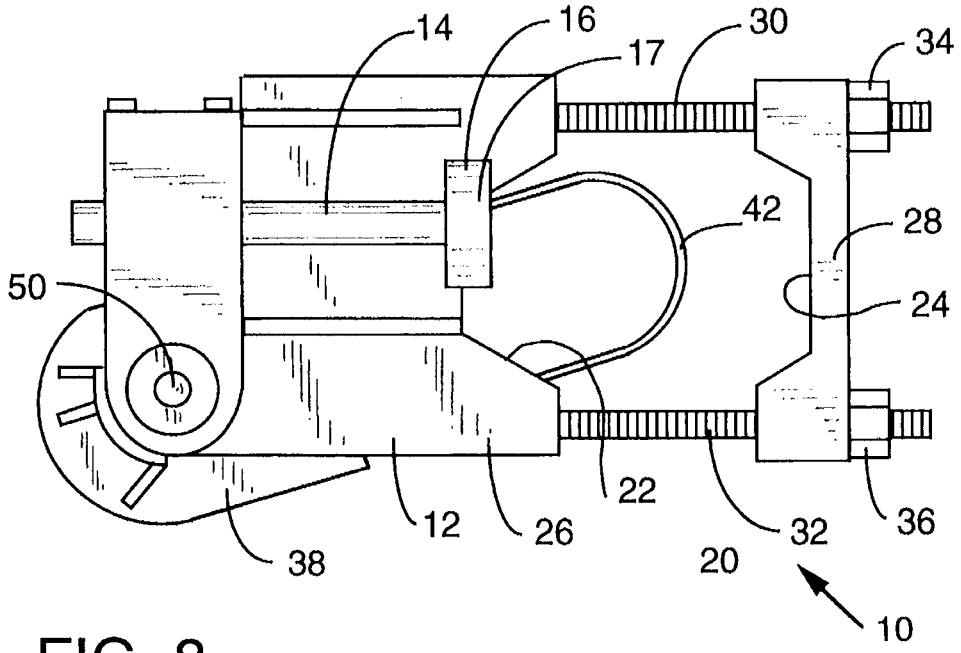
FIG. 8 is a top view of the apparatus of FIG. 1.
Figure 9:
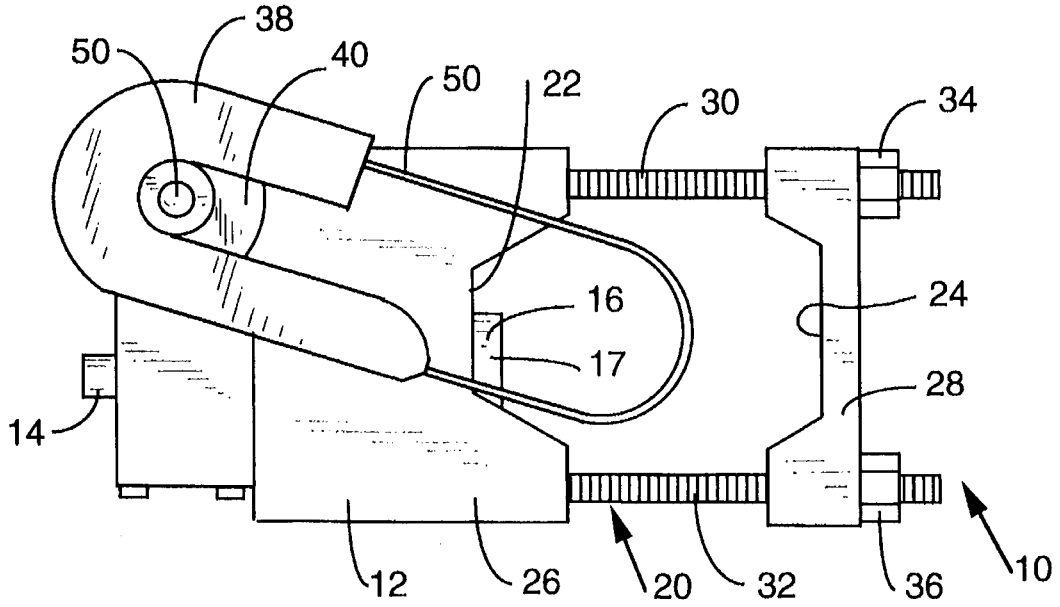
FIG. 9 is a bottom view of the apparatus of FIG. 1.

The shaft 14 is preferably directly supported by or mounted to the support 12, as shown most clearly in FIGS. 2, 3, and 8. Any direct or indirect connection of the shaft 14 to the support 12 is generally acceptable, however, as long as the shaft 14 is fixed relative to the support 12 in a first direction B (see FIGS. 4 and 5). The first direction B is generally perpendicular to an axis C of the shaft 14. The contact piece 16 is eccentrically mounted to the shaft 14 for rotation therewith eccentrically about the axis C, and includes a continuous circumferential contact surface 17 thereon. The contact piece 16 is preferably circular or elliptical in cross-sectional shape.

As shown by a comparison of FIGS. 1 and 2, the rotational drive system 18 is preferably partially encased by the support 12 and partially surrounded by a housing 38 that is attached to the support 12 by means of a bolt 39. The rotational drive system 18 includes a pulley 40, a belt 42 positioned around the pulley 40, and a gear system 44 rotatably connected between the pulley 40 and the shaft 14. The gear system 44 includes a shaft gear 46 rotationally fixed to the shaft 14 for rotation therewith, and a worm gear 48 meshed with the shaft gear 46. The worm gear 48 is rotationally fixed to the pulley 40 for rotation therewith by means of a worm gear shaft 50 upon which the pulley 40 is mounted.

Figure 5:
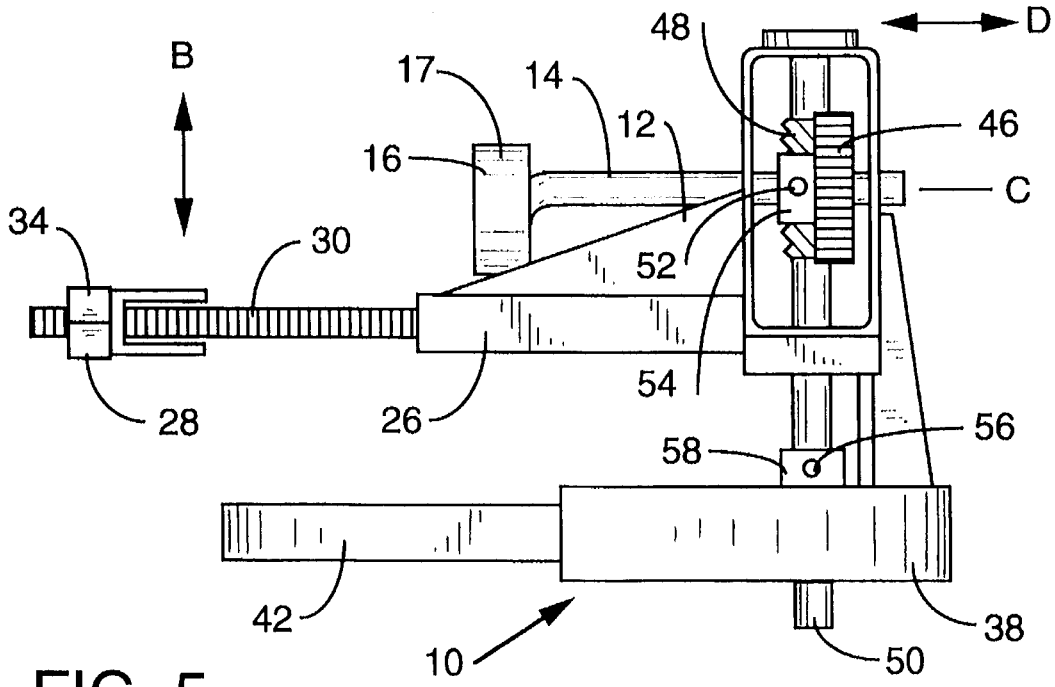
FIG. 5 is a rear elevational view of the apparatus of FIG. 1, with a support cover of the apparatus removed for clarity.
Figure 6:
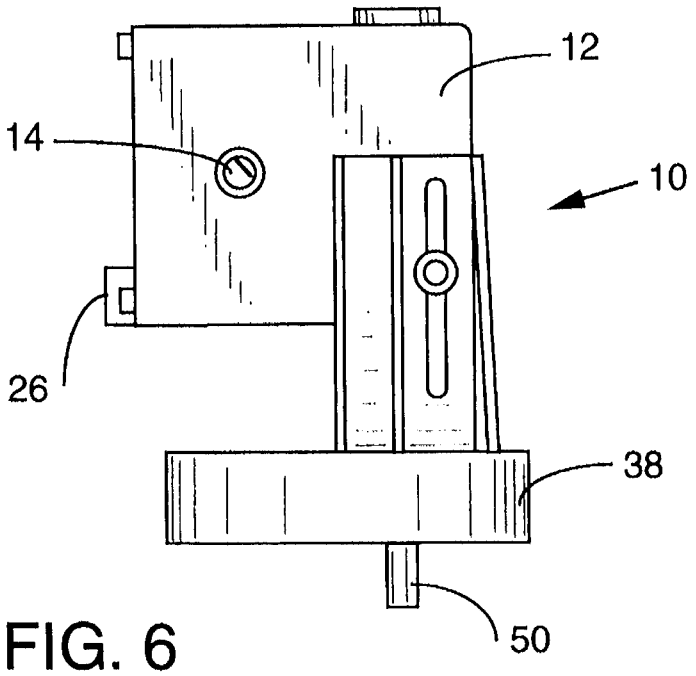
FIG. 6 is a left side elevational view of the apparatus of FIG. 1.
Figure 7:
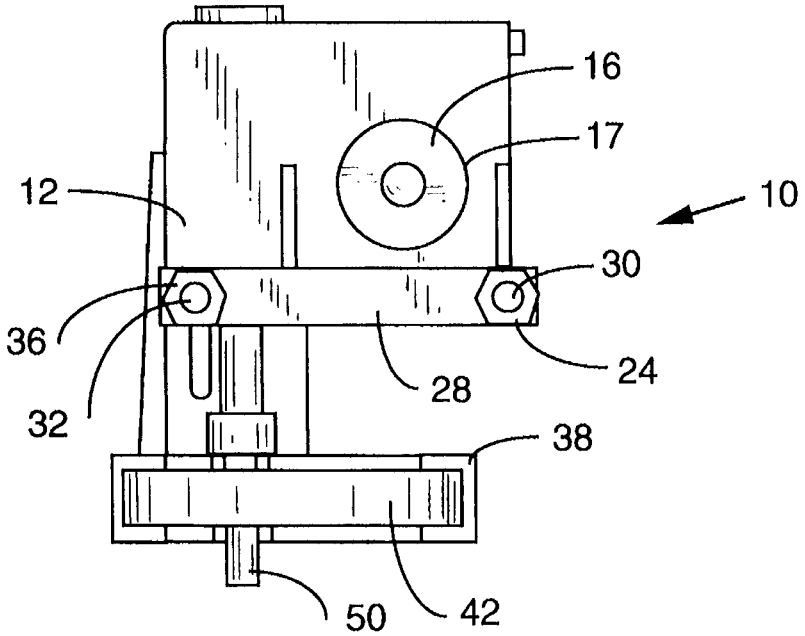
FIG. 7 is a right side elevational view of the apparatus of FIG. 1.

The pulley 40 is translatable relative to the worm gear shaft 50 in the first direction B, and translation of the pulley 40 relative to the worm gear shaft 50 can be selectively restrained by tightening a set screw 56 housed within an extension 58 of the pulley 40. Also, as can be seen in FIG. 5, which is a rear elevational view of the apparatus 10 with a support cover of the support 12 removed for clarity, the shaft gear 46 and the shaft 14 are translatable relative to each other in a second direction D which is generally parallel with the axis C of the shaft 14. A set screw 52 is housed within an extension 54 of the shaft gear 44, and translation of the shaft gear 46 relative to the shaft 14 can be selectively restrained by tightening the set screw 52.

As shown in FIGS. 1–3, the apparatus or linear displacement assembly 10 is preferably used with a tool apparatus such as a drill press 100 having a rotatable spindle 102, and with an abrading tool 200 mounted to the spindle 102. Together the apparatus or assembly 10, the drill press 100 and the abrading tool 200 form an abrading tool apparatus 1 that imparts both rotation and linear oscillation to an abrading tool 200.

The drill press 100 preferably includes a housing 104 which is normally held stationary during use of the apparatus 1, and a spindle 102 which is both rotatable relative to the housing 104, and linearly displaceable relative to the housing 104 in a direction parallel with an axis A of the spindle 102. As will be seen hereinbelow, when the apparatus 10 is mounted to the drill press 100, the direction of linear displacement of the spindle 102 is in the first direction B. The drill press 100 further includes a sheath 106 that is translationally fixed to the spindle 102 for translation therewith and thus is linearly displaceable relative to the housing 104. The spindle 102 is rotatable relative to the sheath 106, such that the sheath 106, like the housing 104, generally does not rotate. The spindle 102 and the sheath 106 are preferably biased upwardly relative to the housing 104, such that absent a contravening force the spindle 102 and the sheath 106 rest in a first, fully retracted position, as shown in FIGS. 1 and 2.

A base 300 may also be provided for supporting a workpiece which is to be abraded by the abrading tool 200. Preferably the base 300 includes an inlet 302 placed adjacent the abrading tool 200, and an outlet 304 connectable to a vacuum source (not shown) to allow dust and other material produced during abrading to be sucked into the inlet 302, through the base 300, and away from the apparatus 1. The inlet 302 may be partially covered by an insert 306 having collection openings 308 therein, which insert 306 can be specially sized to fit around a particular abrading tool 200. Such an insert 306 allows smaller workpieces to be supported adjacent the abrading tool 200, but still allows dust and other material to be sucked into the inlet 302 through the insert openings 308.

With reference to FIGS. 1–9, the structure and operation of the apparatuses 1 and 10 will now be explained. The apparatus 10 is preferably mounted to the drill press 100 by clamping the clamp 20 around the sheath 106, and thus indirectly around the spindle 102. The clamp 20 is preferably clamped in a first position shown in FIGS. 1 and 2, wherein a portion of the contact surface 17 contacts the underside of the housing 104. Clamping is accomplished by tightening the first and second nuts 34, 36 along the first and second threaded rods 30, 32 until the first and second clamping surfaces 22, 24 are firmly clamped against either side of the sheath 106. When the clamp 20 is clamped, translation or linear displacement of the sheath 106, and thus of the spindle 102, relative to the support 12 in the first direction B is restrained. Although the apparatus 10 is shown in FIGS. 1–3 as extending at roughly a right angle to the housing, the clamp 20 may be clamped around the sheath 106 at any one of a number of different angles relative to the housing 104. Such a modified orientation could be necessary if, for instance, a right angle orientation is unavailable due to contact between the apparatus 10 and an extension or portion of a housing of a particular type of drill press.

If the contact piece 16 is not fully underneath the housing 104, the support cover (not shown) of the support 12 can be removed from the support 12 so that the set screw 52 housed in the extension 54 of the shaft gear 46 is accessible. The set screw 52 can be loosened, and the shaft 14 slid in the second direction D until the contact piece 16 is fully underneath the housing 104. The set screw is then tightened so that translation of the shaft 14 relative to the shaft gear 46 in the second direction D is again restrained.

If the pulley 40 is already parallel with an acceptable portion of the spindle 102, the belt 42 is then positioned around both the spindle 102 and the pulley 40 such that it is frictionally held around both of them. If the pulley 40 is not parallel with an acceptable portion of the spindle 102, the set screw 56 housed in the extension 58 of the pulley 40 can be loosened, the pulley 40 raised or lowered to an acceptable position, and the set screw 56 tightened to restrain further translation of the pulley 40 relative to the worm gear shaft 50. The belt 42 can then be properly positioned.

When an operator desires to abrade a workpiece using the abrading tool apparatus 1, he or she turns on the drill press 100, which causes the rotatable spindle 102 and thus the abrading tool 200 to rotate at relatively high speed. The belt 42 also rotates with the spindle 102, which causes the pulley 40, the worm gear 48, the shaft gear 46, and thus the shaft 14 to rotate. Because the contact piece 16 is eccentrically mounted to the shaft 14, it rotates eccentrically about the shaft 14 as the shaft 14 rotates. As the contact piece 16 rotates from the first position shown in FIG. 2 to a second position shown in FIG. 3, the contact surface 17 pushes the shaft 14 downwardly in the first direction B relative to the housing 104. Because translation of the shaft 14 relative to the support 12 in the first direction B is restrained, a distance between underside of the housing 104 and the support 12 (or the portion of the contact surface 17 contacting the housing 104 and the support 12) increases in the first direction B. Because translation of the support 12 relative to the spindle 102 in the first direction B is restrained by the clamp 20, the spindle 102 is linearly displaced with the support 12 relative to the housing 104 and the base 300, as shown in FIG. 3.

When the contact piece 16 reaches the second position shown in FIG. 3, it is unable to displace the shaft 14 and the spindle 102 any further relative to the housing 104. At that point the bias on the spindle 102 begins to pull the spindle 102 and thus the shaft 14 back upwardly as the distance between the support 12 and the portion of the contact surface 17 contacting the housing 104 lessens in the first direction B. The spindle 102 is thus pulled upwardly toward the housing 104 until the contact piece 16 again reaches the first position shown in FIG. 2. In this manner, the spindle 102 and the rotating abrading tool 200 are periodically linearly displaced, i.e., they linearly oscillate in the first direction B.

A workpiece to be abraded is thus placed on the base 300, and is abraded by the linearly oscillating, rotating abrading tool 200 as desired by the operator. Dust and other material produced by the abrading operation are preferably sucked through the insert openings 308, into the inlet 302, through the base 300, and out the outlet 304 to a vacuum source.

The apparatus 10 thus allows a standard tool apparatus such as the drill press 100 to function as an oscillating, rotating abrading tool apparatus 1 without an extra power source, and thus provides an oscillating, rotating abrading tool to a workshop relatively inexpensively and without taking up a lot of extra space. Additionally, when an operator desires to use the drill press 100 for its normal intended function, the operator can simply remove the belt 42 from around the spindle 102 and the pulley 40, to disable the apparatus 10. The apparatus 10 thus advantageously allows the drill press 100 to convert between functions with relatively little effort on the part of an operator.

It is to be understood that, while not shown in the drawings, it is within the scope of the invention for the clamp of the support 12 to clamp directly around the spindle 102, rather than around the sheath 106 and thus only indirectly around the spindle 102. In such a case, the clamp 20 would be rotatable with the spindle 102 relative to the support 12 but would be translationally fixed relative to the support 12, such as by a ball bearing or other rotational joint. Additionally, it is within the scope of the present invention for the drive system 18 to be located partially or wholly outside of the support 18 and the housing 38. It is further within the scope of the present invention for the shaft 14 to be fixed to a piece other the support 12, such that the shaft 14 is connected only indirectly to the support 12, as long a distance between the shaft 14 and the support 12 in the first direction B is fixed.

The principles, a preferred embodiment and the mode of operation of the present invention have been described in the foregoing specification. However, the invention which is intended to be protected is not to be construed as limited to the particular embodiment disclosed. The embodiment is therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. An apparatus for linearly displacing a rotatable spindle relative to an object, comprising:

a support, said support being connectable to the spindle such that translation of the spindle relative to said support in a first direction is restrained;

a rotatable shaft, said rotatable shaft being connected to said support such that translation of said shaft relative to said support in said first direction is restrained;

a rotational drive system rotatably connected to said shaft and rotatably connectable to the spindle, to transmit rotational drive from the spindle to said shaft; and a contact piece eccentrically mounted to said shaft, wherein said contact piece has a contact surface thereon for contact with the object, and wherein rotation of said shaft varies a distance, measured in said first direction, between said support and a portion of said contact surface contacting the object, such that the spindle is linearly displaceable relative to the object.

2. The apparatus as claimed in claim 1, wherein said rotational drive system includes a pulley, a belt positioned around said pulley and positionable around the spindle, and a gear system rotatably connected between said pulley and said shaft.

3. The apparatus as claimed in claim 2, wherein said gear system includes a shaft gear rotationally fixed to said shaft for rotation therewith, and a worm gear meshed with said shaft gear and rotationally fixed to said pulley for rotation therewith.

4. The apparatus as claimed in claim 1, wherein said rotational drive system includes a shaft gear, said shaft gear being rotationally fixed to said shaft for rotation therewith and translatable relative to said shaft in a second direction.

5. The apparatus as claimed in claim 4, further including a set screw housed within said shaft gear to selectively restrain translation of said shaft relative to said shaft gear in said second direction.

6. The apparatus as claimed in claim 1, wherein said contact surface is a continuous circumferential surface of said contact piece.

7. The apparatus as claimed in claim 1, wherein said support includes a clamp to clamp around the spindle and restrain translation of the spindle relative to said clamp.

8. An apparatus for linearly displacing a rotatable spindle relative to an object, comprising:

rotatable shaft means;

support means for supporting said shaft means and restraining translation of said shaft means relative to said support means in a first direction, said support means including means for restraining translation of the spindle relative to said support means in said first direction;

rotational drive means, rotatably connected to said shaft means and rotatably connectable to the spindle, for transmitting rotational drive from the spindle to said shaft; and contact means eccentrically mounted to said shaft means, wherein said contact means includes a contact surface for contacting the object, and wherein rotation of said shaft means varies a distance, measured in said first direction, between said support means and a portion of said contact surface contacting the object, such that the spindle is linearly displaceable relative to the object.

9. The apparatus as claimed in claim 8, wherein said rotational drive means includes a pulley, a belt positioned around said pulley and positionable around the spindle, and gear means for rotatably connecting said pulley and said shaft.

10. The apparatus as claimed in claim 9, wherein said gear means includes a shaft gear rotationally fixed to said shaft means for rotation therewith, and a worm gear meshed with said shaft gear and rotationally fixed to said pulley for rotation therewith.

11. The apparatus as claimed in claim 8, wherein said rotational drive means includes a shaft gear, said shaft gear being rotationally fixed to said shaft means for rotation therewith and translatable relative to said shaft means in a second direction.

12. The apparatus as claimed in claim 11, further including a set screw housed within said shaft gear to selectively restrain translation of said shaft means relative to said shaft gear in said second direction.

13. The apparatus as claimed in claim 8, wherein said contact surface is a continuous circumferential surface of said contact means.

14. The apparatus as claimed in claim 8, wherein said restraining means includes clamp means for clamping around the spindle.

15. An abrasive tool apparatus, comprising:

(a) a drill press, said drill press including a housing, a spindle, said spindle being rotatable relative to said housing and linearly displaceable relative to said housing in a first direction;

(b) a linear displacement assembly, said assembly including a rotatable shaft, said shaft being connected to said spindle such that translation of said shaft relative to said spindle in said first direction is restrained, a rotational drive system rotatably connected between said spindle and said shaft to transmit rotational drive from said spindle to said shaft, and a contact piece eccentrically mounted to said shaft and in contact with said housing, wherein rotation of said shaft varies a distance, measured in said first direction, between said housing and said shaft, such that rotation of said spindle linearly displaces said spindle relative to said housing; and (c) an abrasive tool fixed to said spindle.

16. The apparatus as claimed in claim 15, wherein said rotational drive system includes a pulley, a belt positioned around said pulley and said spindle, and a gear system rotatably connected between said pulley and said shaft.

17. The apparatus as claimed in claim 16, wherein said gear system includes a shaft gear rotationally fixed to said shaft for rotation therewith, and a worm gear meshed with said shaft gear and rotationally fixed to said pulley for rotation therewith.

18. The apparatus as claimed in claim 15, wherein said rotational drive system includes a shaft gear, said shaft gear being rotationally fixed to said shaft for rotation therewith and translatable relative to said shaft in a second direction.

19. The apparatus as claimed in claim 18, further including a set screw housed within said shaft gear to selectively restrain translation of said shaft relative to said shaft gear in said second direction.

20. The apparatus as claimed in claim 15, wherein said contact piece includes a continuous contact surface on an outer circumference thereof, said contact surface contacting said housing.

21. The apparatus as claimed in claim 15, wherein said shaft is connected to said spindle by a support, wherein said support is connected to said spindle such that translation of said spindle relative to said support in said first direction is restrained, and is connected to said shaft such that translation of said shaft relative to said support in said first direction is also restrained.

22. The apparatus as claimed in claim 21, wherein said support includes a clamp clamped around said spindle to restrain translation of said spindle relative to said clamp.

23. The apparatus as claimed in claim 21, wherein said spindle is biased toward said housing in said first direction, and said eccentric rotation of said contact piece periodically linearly displaces said spindle against said bias, such that said eccentric rotation causes said spindle to linearly oscillate in said first direction relative to said housing.

24. The apparatus as claimed in claim 15, further including a base for supporting a workpiece to be abraded by said abrading tool, said base including an inlet adjacent said abrading tool for collecting abraded material, and an outlet connectable to a vacuum source.

* * * * *